US006598510B1

(12) United States Patent
Kim

(10) Patent No.: US 6,598,510 B1
(45) Date of Patent: Jul. 29, 2003

(54) POLYGONAL BRAID AND BRAIDING MACHINE

(76) Inventor: Im-Sun Kim, 291, Daepung-ri, Chogae-myun, Hapchun-gun, 678-820, Kyungsangnam-do (KR)

( * ) Notice: Subject to any disclaimer, the term of this patent is extended or adjusted under 35 U.S.C. 154(b) by 0 days.

(21) Appl. No.: 09/857,756

(22) PCT Filed: May 22, 2000

(86) PCT No.: PCT/KR00/00510

§ 371 (c)(1),
(2), (4) Date: Jun. 7, 2001

(87) PCT Pub. No.: WO01/49911

PCT Pub. Date: Jul. 12, 2001

(30) Foreign Application Priority Data

Jan. 4, 2000 (KR) ..... 00-181

(51) Int. Cl.[7] ..... D04C 3/20

(52) U.S. Cl. ..... 87/33; 87/8; 87/11; 87/13; 87/41; 87/62

(58) Field of Search ..... 87/5, 6, 8, 9, 11, 87/13, 14, 16, 17, 28, 29, 33, 34, 35, 41, 62

(56) References Cited

U.S. PATENT DOCUMENTS

| | | | | | |
|---|---|---|---|---|---|
| 2,469,178 A | * | 5/1949 | Salvans | 87/6 |
| 4,096,781 A | * | 6/1978 | Bock et al. | 87/28 |
| 4,333,380 A | | 6/1982 | Kozlowski | 87/6 |
| 4,803,909 A | * | 2/1989 | Smith | 87/6 |
| 5,146,836 A | | 9/1992 | DeYoung | 87/22 |
| 5,910,204 A | * | 6/1999 | Carrara | 87/31 |
| 5,931,077 A | * | 8/1999 | De Young | 87/44 |

FOREIGN PATENT DOCUMENTS

| | | | |
|---|---|---|---|
| JP | 52152556 | * | 12/1977 |
| JP | 52-152556 | | 12/1977 |
| JP | 55-128057 | | 10/1980 |
| JP | 2000178855 A | * | 6/2000 |

* cited by examiner

*Primary Examiner*—John J. Calvert
*Assistant Examiner*—Shaun R Hurley

(57) ABSTRACT

The present invention relates to a braider comprising a guiding plate, of which a plurality of the paths are intersected with one another; and a corresponding conveying gear.

With combination of the guiding plate and the conveying gear, it is possible to produce polygonal braids, such as rectangular braids or triangle braids, and to provide various colors on the braids as different braided yarns are braided on the corresponding surfaces respectively.

Furthermore, with the rectangular braids or triangle braids, the banding force is enhanced as the frictione is increased when they are united. Therefore, the braids are not easy to loosen if they are used as banding braids for footwear or clothes.

7 Claims, 8 Drawing Sheets

POLYGONAL BRAID AND BRAIDING MACHINE

TECHNICAL FIELD

The present invention relates to a braid and a braiding machine, and more particularly, to a polygonal braid and a braiding machine therefor, in which a guide plate having a track capable of braiding a polygonal braid and a feed gear corresponding thereto are provided. The polygonal braid braided in a square or triangular shape can be utilized as a binding string for shoes or clothes etc because of increased binding force by a polygonal. Braids of various quality and colors may be created by using different qualities or colors of strands.

BACKGROUND ART

Braids are utilized in several fields, for example, as part of an electric wire or hose, as a binding string etc. A specific braid is formed on the outer circumference of the electric wire or the string and provides an elastic and relaxed covering for an interior electrc wire or a string etc. and protects the interior electric wire from being contaminated or damaged by impact, braids are often used in place of string for daily use in shoes or clothes etc., in addition to specialized uses.

A general braider is composed of a guide plate having a track on which a spool is moved, a feed gear for moving an electric spool along the track the guide plate, a driving gear for driving a plurality of feed gears and a plural number of rollers on which a braided wire is wound, etc.

FIG. 6*a* shows a guide plate for manufacturing a general cylindric braid and its braid. On this guide plate 100, two tracks 101, 101' on a gentle circular curve line of a jig jag shape are formed, intersected with each other. As shown in FIG. 6*b*, on its lower part, a plurality of feed gears 102, 102' are positioned beneath and aligned within the intersected curves of tracks 101, 101'. In such construction, the plurality of feed gears 102, 102' are simultaneously rotated by a rotation of the driving gear 103, yarn from separate spools are combined within feed gears 102, 102' onto the guid plate 100 which is rotated.

Therefore, a plural number of spools of yarn are rotated, repeatedly performing a rotation and a revolution centering around a center point of the guide plate 100, feeding out yarn, which are intersected with one another, rotating along the track 101, 101'.

On an outer circumference of the central yarn, thus, a braid based on a cylindric shape is produced by the rotation of the spool as shown in FIG. 6*c*.

DISCLOSURE OF INVENTION

The ordinary cylindrical braid as described above, when used as a binding of shoes, has a low frictional force due to the cylindrical shape which can result in the shoe lace coming loose.

Whan a braid is made using a single color, by prior art methods, the brain color is monotonous; when using a single color, by prior art methods, the braid color is monotonous; when using various colored braid, the braid color may appear untidy.

In order to overcome the problems presented in prior art braiding methods, the present invention teaches a braid formed in a polygonal shape such as a triangle or a square shape with each edge of each face the polygon intersecting with an edge of the adjoining face of the polygon.

BRIEF DESCRIPTION OF DRAWINGS

The accompanying drawings, which are included to provide a further understanding of the invention and are incorporated in and constitute a part of the specification, illustrate embodiments of the invention and together with the description serve to explain the principles of the invention.

In the drawings:

FIGS. 4*a* through 4*d* set forth main schematic views of main parts showing a braiding of a square braid, wherein FIG. 4*a* is a plan explanatory view of a guide plate, FIG. 4*b* is an installment state view of a feed gear. FIG. 4*c* is a perspective view showing a square braid provided under a braiding state, and FIG. 4*d* is a plan view showing a square braid under a braiding state;

FIGS. 5*a* to 5*d* depict schematic views of main parts showing a braiding of a triangular braid, wherein FIG. 5*a* is a plan explanatory view of a guide plate. FIG. 5*b* is an installment state view of a feed gear, FIG. 5*c* is a perspective view showing a triangular braid under a braiding state, and FIG. 5*d* is a plan view showing a triangular braid under a braiding state;

FIGS. 6*a* to 6*c* provide schematic views of a braiding mechanism of the prior art wherein, FIG. 6*a* is a plan view of guide plate, FIG. 6*b* is a view of a feed gear installed, FIG. 6*c* is a perspective view showing a cylindrical braid produced thereby.

BEST MODE FOR CARRYING OUT THE INVENTION

Reference will now be made in detail to the preferred embodiments of the present invention, examples of which are illustrated in the accompanying drawings.

Figure 1:
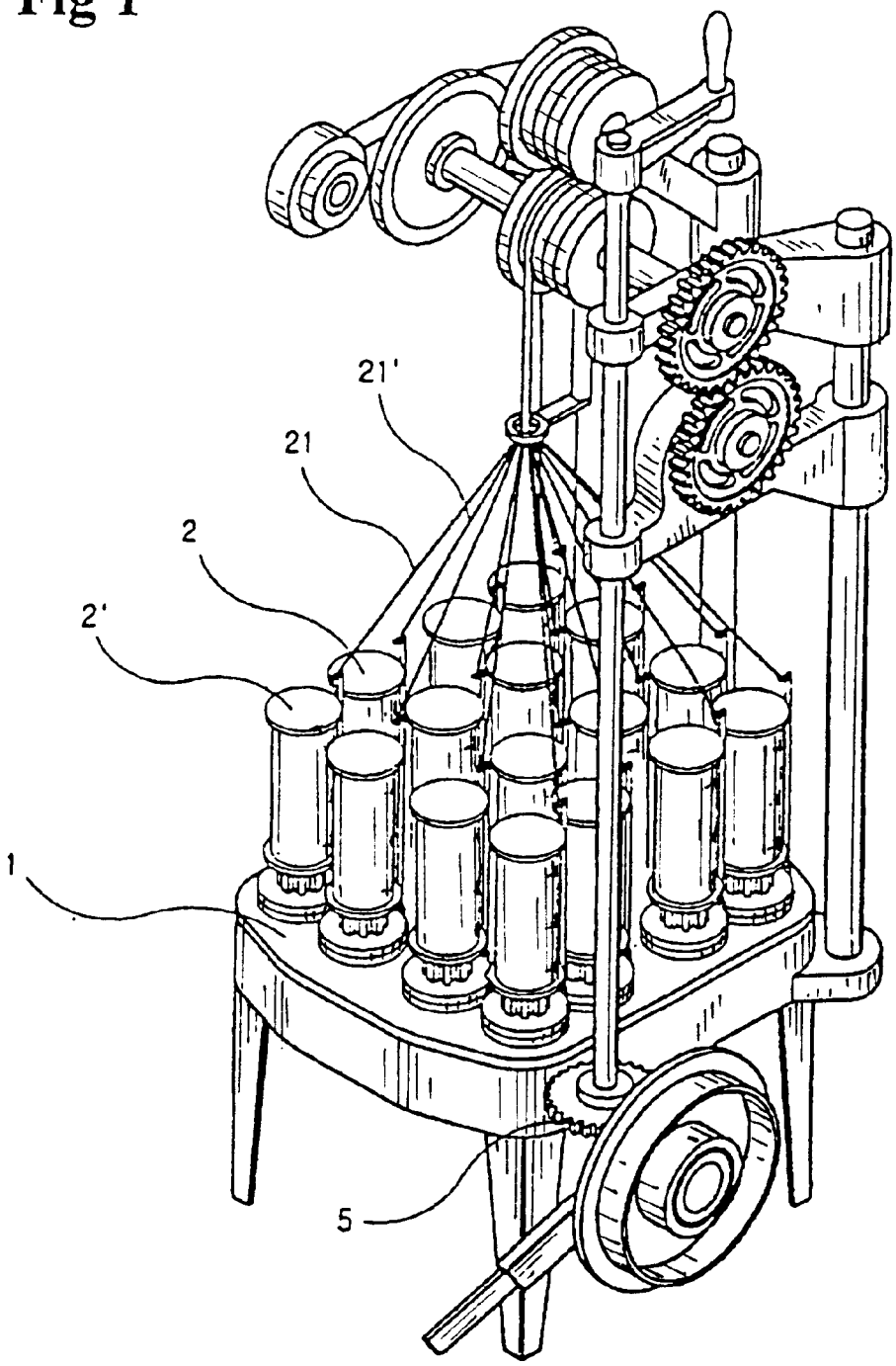
FIG. 1 indicates an overall perspective view of a braiding machine.
Figure 2:
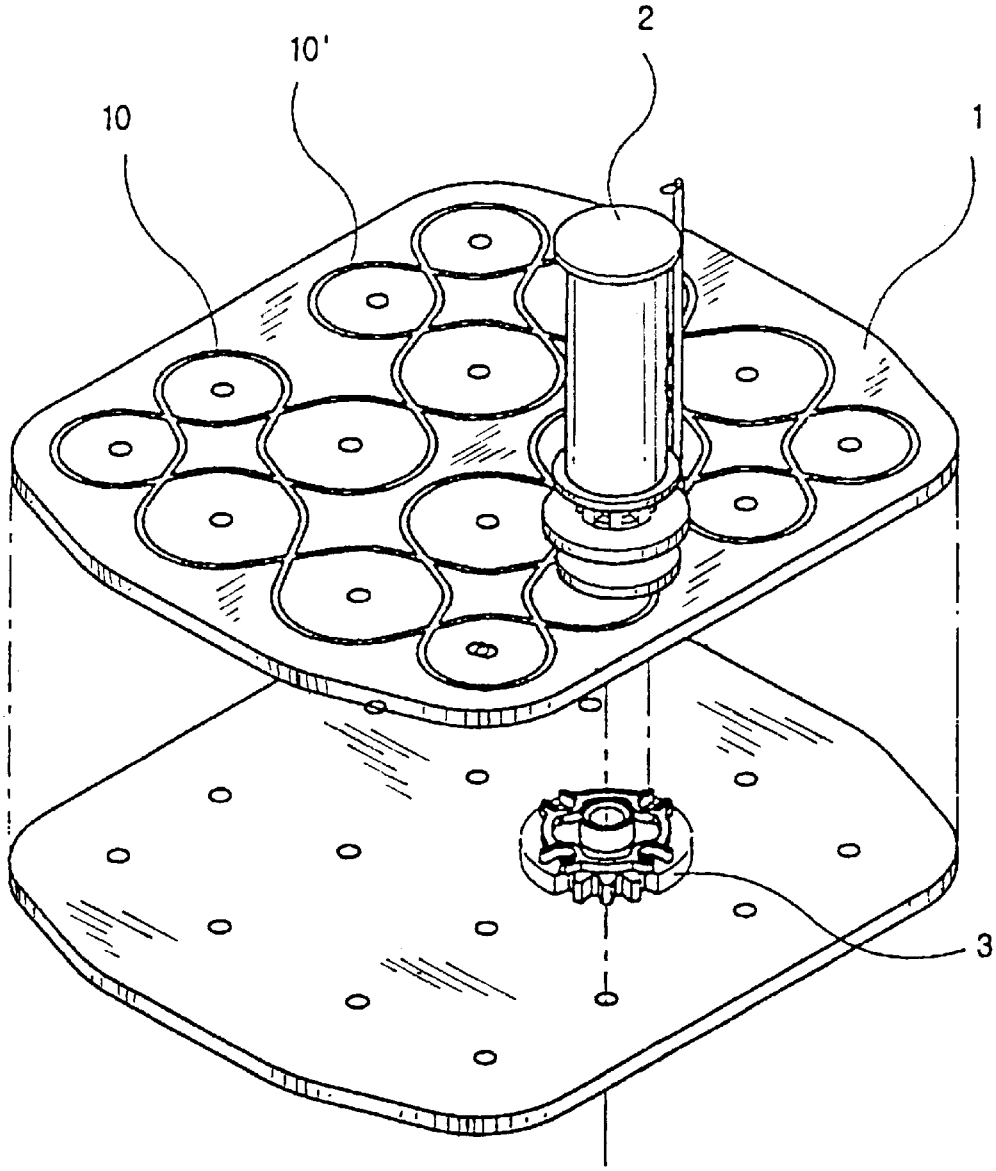
FIG. 2 represents a separated perspective view for a part of a braiding machine in accordance with the present invention.
Figure 3:
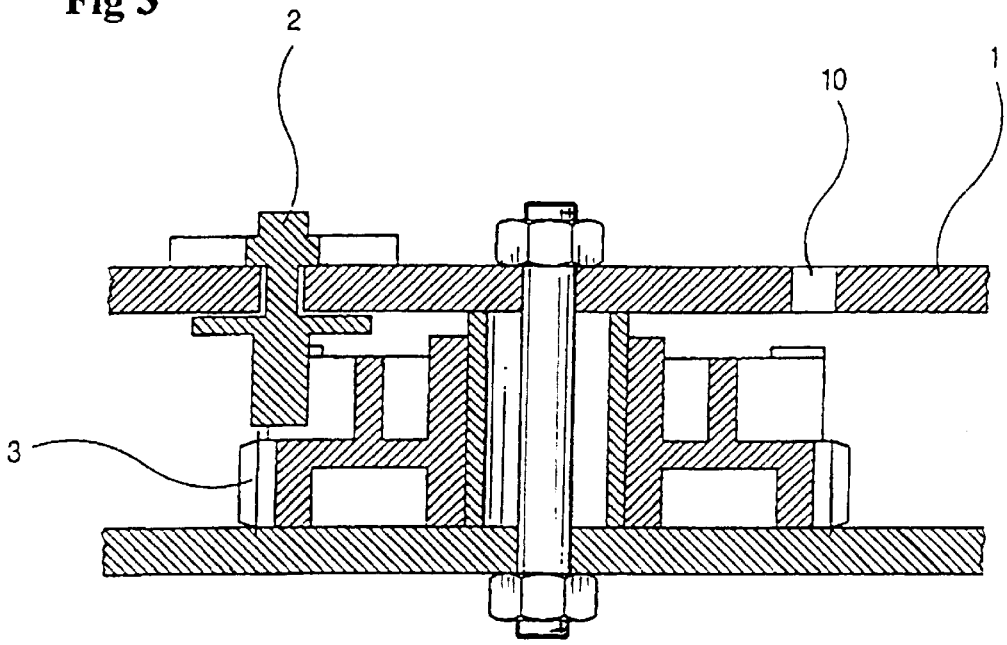
FIG. 3 is an enlarged sectional view for a part of the inventive braiding machine.

FIG. 1 is an overall perspective view of a braiding machine, FIG. 2 is an enlarged separate perspective view partially showing a braiding machine in accordance with the present invention, and FIG. 3 represents its sectional explanatory view.

As shown in FIG. 4, braid 22 is created be weaving numerous braiding yarns 21, 21' on an outer circumference of a central yarn 20, the braid 22 is formed in a polygonal shape by sections where respective faces 23, 23' are formed by braiding numerous braiding yarns 21, 21'. On a boundary part which each face 23 meets with each face 23', the braiding yarns 21, 21' formed on both side faces are cross-braided so that the respective faces 23, 23' are combined with each other.

A braiding machine for creating such a braid is provided with a plurality of spools 2, 2' positioned on an upper part of a guide plate 1, a plural number of feed gears 3, 3' attached to the carriers 2, 2' are rotatably combined with each other in a lower part of the guide plate 1, a driving gear 5 for driving these feed gears is combined therewith. In order to get the inventive braiding machine from such general braiding machine, that is, onto the guide plate 1, "∞" shape tracks 10, 10' having an intersection C1 are formed. The number of C1 intersections are determined by the number of faces of the braid to be made in a polygonal type.

One loop of one "∞" shape track 10 is intersected with one loop of another "∞" shape track 10', to so form another intersection C2, and the feed gears 3, 3' positioned in the lower part thereof are installed so that they are centered within each loop of the "∞" shape tracks 10, 10'.

Figure 4A:
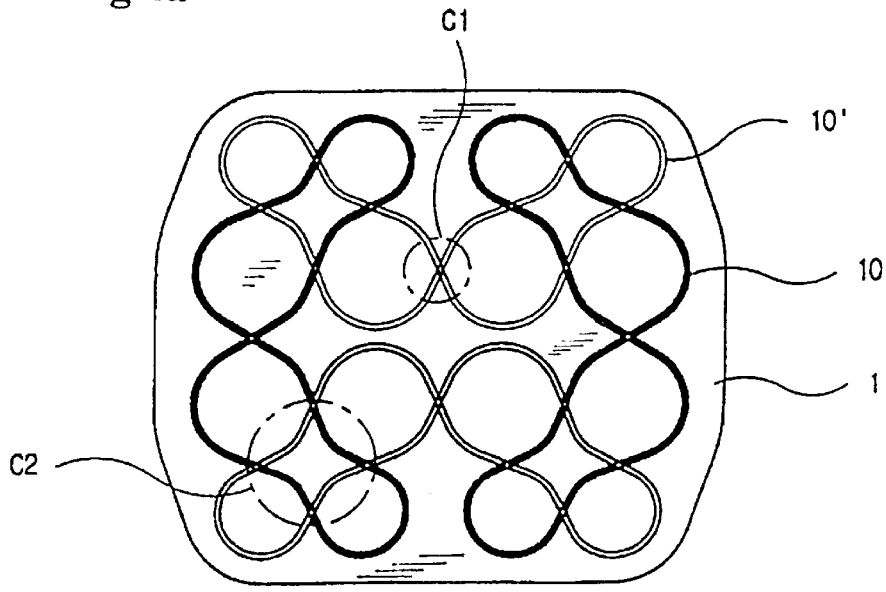
Figure 5A:
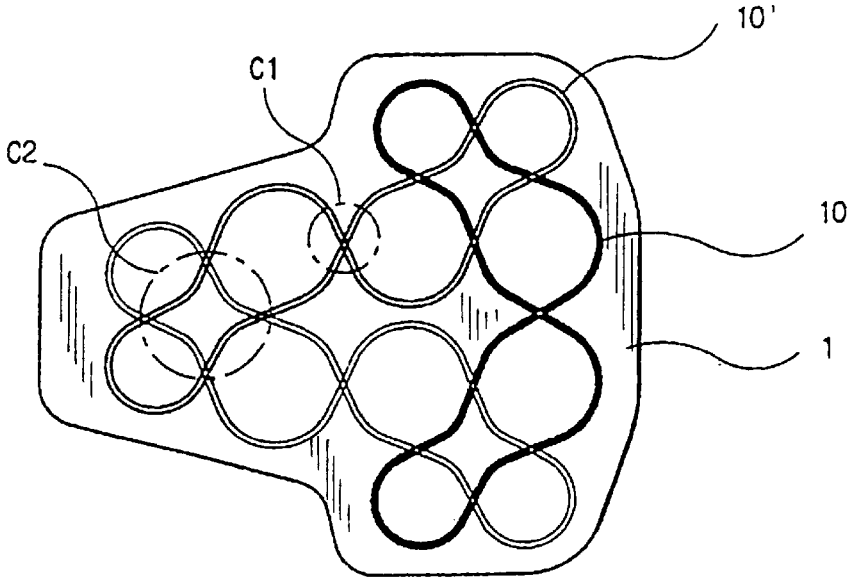

The guide plate 1 having such "∞" shape tracks 10, 10' is connected to the feed gears 3, 3', and in such construction, a square braid 22 or a triangular braid 22 can be obtained. That is, the square braid 22 is obtained by forming four "∞"' shape tracks 10, 10' in such a way that both loops of the four tracks are intersected as shown in FIG. 4*a*. The triangular braid 22 is obtained by forming three "∞" shape tracks 10, 10' in such a way that both loops of the respective tracks are intersected as shown in FIG. 5*a*.

A plurality of C1 of such "∞" shape tracks 10, 10' may be constructed.

The inventive operations with such construction are described more in detail, referring to the drawings.

Describing a schematic operating state of the inventive braider, the plurality of feed gears 3, 3' are interlocked by a rotation of the driving gear 5, and as shown in FIG. 3, the feed gears 3, 3' and the spools 2, 2' inserted and supported by the feed gears 3, 3' are moved according to the rotation of the feed gears 3, 3'. The spools 2, 2' move from one feed gear 3 along tracks 10, 10' of the guide plate 1, to be then moved to another feed gear 3' and so as to be moved along the tracks 10, 10'.

Such tracks are provided so that spools 2, 2' do not collide with one another but the paths of each other are intersected and the braiding yarns 21, 21' fed from the respective spools 2, 2' are braided, wrapping around the outer circumference face of a central yarn 20.

Such central yarn is wound by a specific roller in a constant speed, to thus get a completed braid product.

In this braid, as shown in FIG. 4*a*, the square braid 22 is formed by four intersected "∞" shape tracks 10, 10'. That is, in the intersection C1 of the individual "∞" shape tracks 10, 10', the braid is formed in a center part of each face, and the intersection C2 of both sides of the individual tracks, the braiding yarns 21, 21' from the two faces 23, 23' are braided so as to be intersected with one another, therefore, four faces respectively distinguished from each other and braided are connected with one another, to be thus braided.

In other words, in the square face sectionally, each track 10, 10' forms one face. In the separate intersection C1 provided within that track 10, 10', a central part of the faces 23, 23' is formed by a cross movement of the spools 2, 2', and in the intersection C2 on which both sides of the respective tracks 10, 10' are intersected, the respective faces are intersected with each other, to obtain the braiding. A completed square braid 22 is shown in FIGS. 4*c* and 4*d*.

A plurality of such intersections C1 are formed, to obtain the braid. Thus, the braid can be used in place of a rather thick string.

Figure 4B:
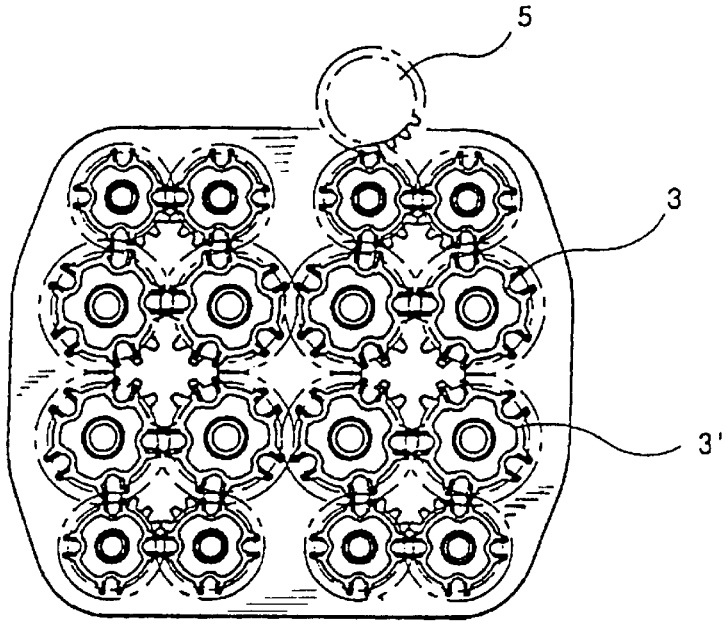
Figure 4C:
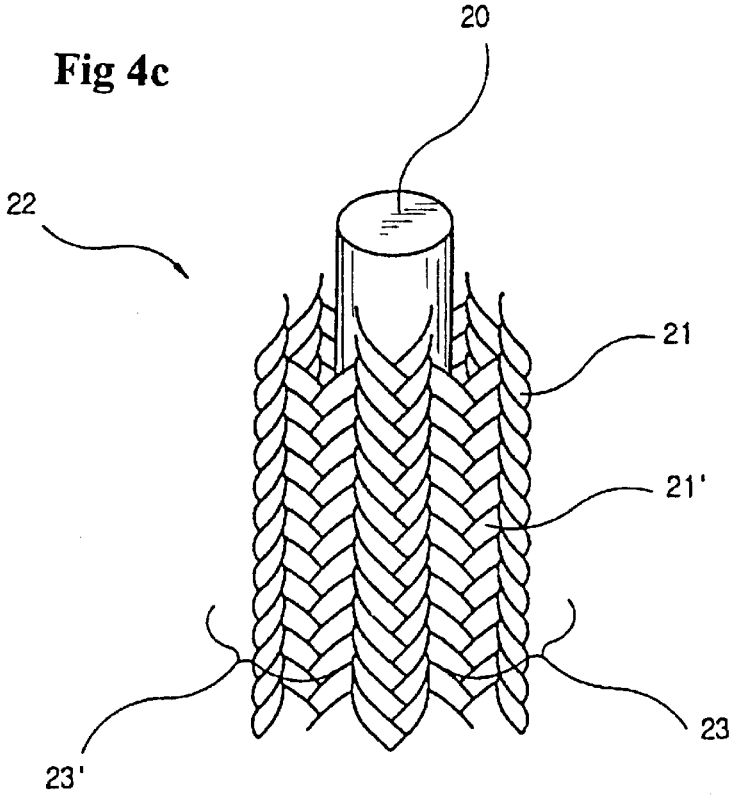
Figure 4D:
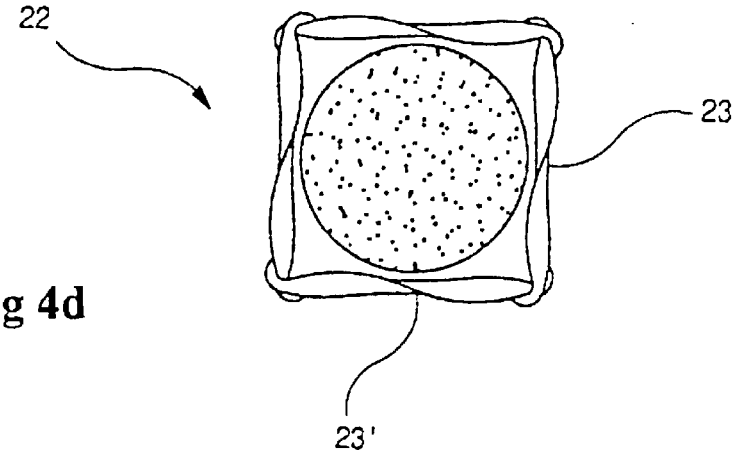

The intersection movement of the spools 2, 2' is provided by the rotation of the plurality of feed gears 3, 3' as shown in FIG. 4*b*, and this rotation force is produced by the interlocking operation caused by the rotation of the driving gear 5.

That is to say, all the respective feed gears 3, 3' are rotatably installed in the lower part attached to both loops of the "∞" shape tracks 10, 10', whereby the spools 2, 2' on te upper part are moved along the tracks 10, 10' by the rotation of the feed gears 3, 3'.

Figure 5B:
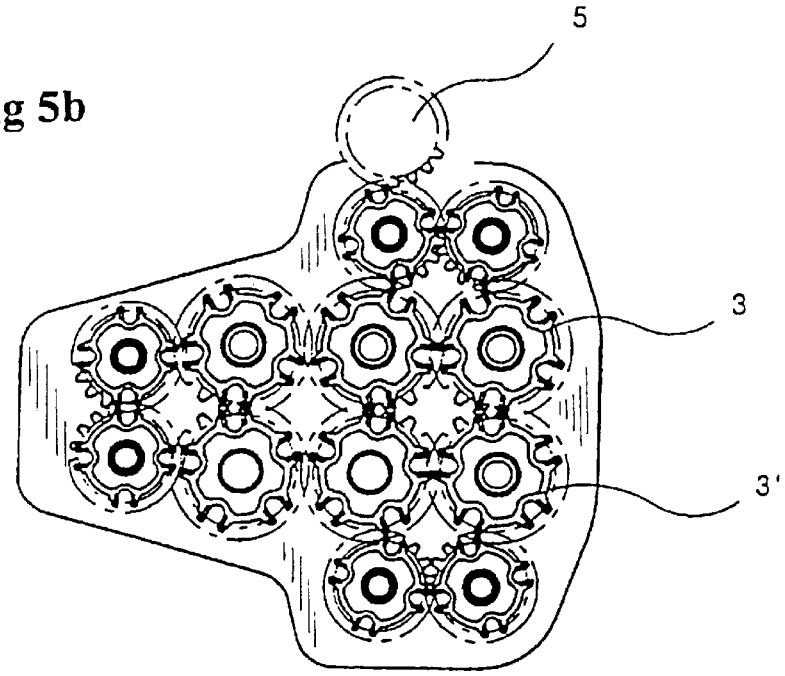
Figure 5C:
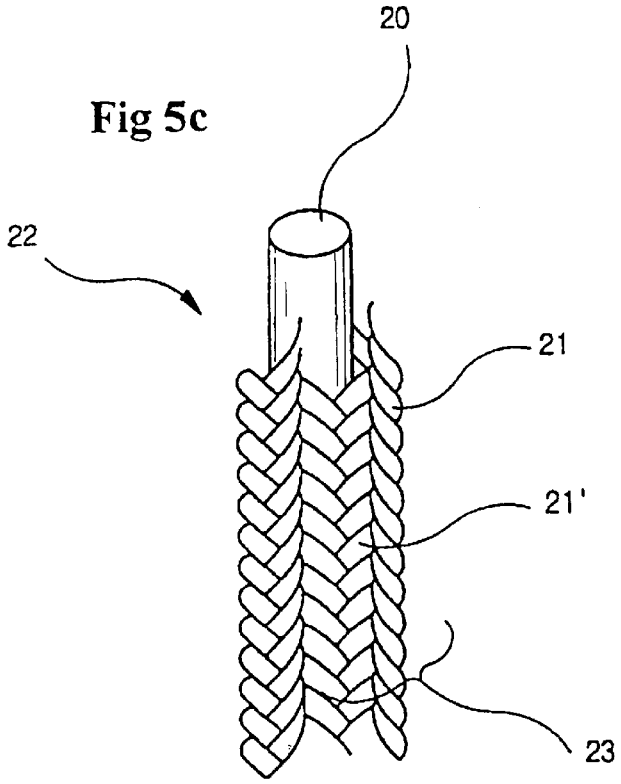
Figure 5D:
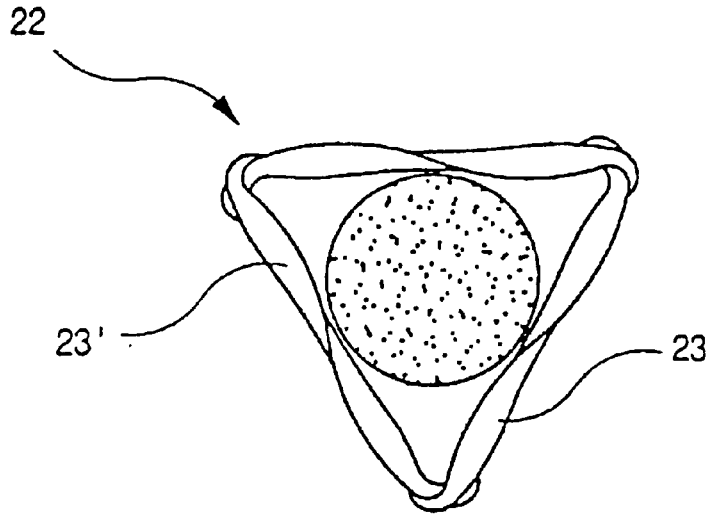
Figure 6A:
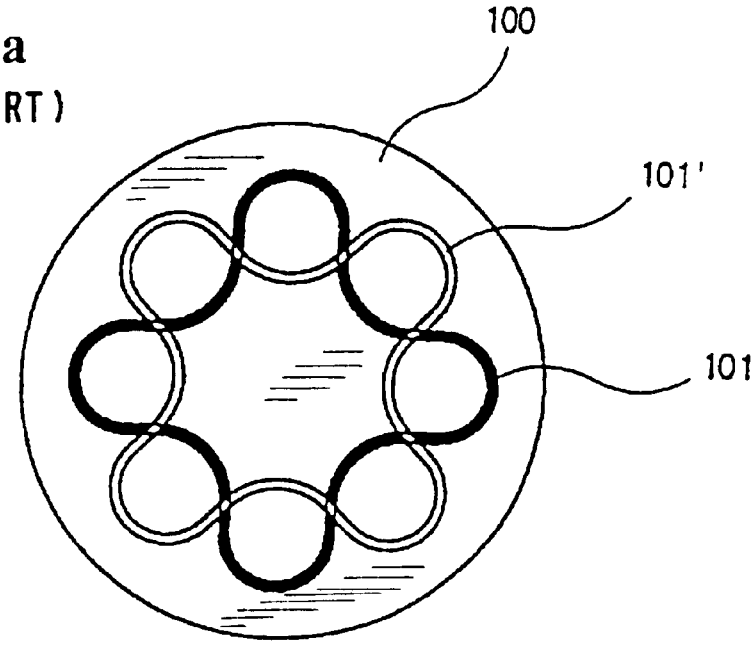
Fig 6a (PRIOR ART)
Figure 6B:
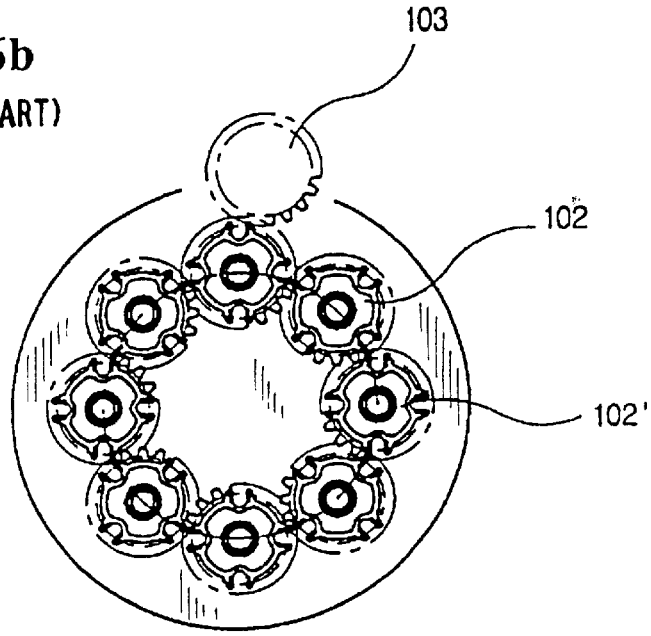
Fig 6b (PRIOR ART)
Figure 6C:
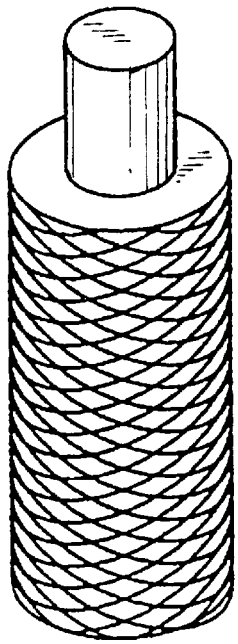
Fig 6c (PRIOR ART)

As shown in FIG. 5*a*, three "∞" shape tracks 10, 10' are formed on the guide plate 1, and as shown in FIG. 5*b*, a plurality of feed gears 3, 3' are connected therewith. Therefore, in the intersection C1 of the individual "∞" shape tracks 10, 10' itself, each face of the braid is formed, and in the intersection C2 of both sides of the individual "∞" shape tracks 10, 10', mutually different faces are intersected and then are braided, to form the triangular braid 22 as shown in FIGS. 5*c* and 5*d*.

Accordingly, in the invention, since the spools 2, 2' are moved within only a separate section of a polygonal face, in contrast to the prior art in which braiding yarns are rotated around an overall outer circumference face of the central yarn 20 to perform a mixed braiding, the mixed color is not produced as in the prior art even though various colors are used. Colors of the braid formed on individual faces can be formed separately. In addition, in binding objects through a use of inventive braid, namely, in case that the braid is utilized as a string for a binding usage such as in shoes or clothes etc., the frictional force on a sectional face is increased, thus solving problems caused by weak binding force, such as a loosening of shoe laces.

INDUSTRIAL APPLICABILITY

As afore-mentioned, in accordance with the present invention, there is provided a polygonal braid and a braiding machine therefor, in which a square-braid as well as a triangular braid can be obtained. A polygonal braid can be produced having different colors on each face. The braid produced by this apparatus has an improved binding force for use in shoes and clothing.

What is claimed is:

1. A polygonal braid having a plurality of faces is woven around an outer circumference of an internal central yarn wherein each face has two edges and each edge of each face is woven to the edge of adjoining face.

2. The polygonal braid of claim 1, wherein said braid is formed in a square shape.

3. The polygonal braid of claim 1, wherein said braid is formed in a triangular shape.

4. A braiding machine of a polygonal braid comprising a plurality of spools positioned on an upper part of a guide plate, a plural number of feed gears connected to the spools rotatably combined with each other in a lower part of the guide plate, and a driving gear for driving the feed gears connected therewith, said machine characterized in that, the guide plate has a number of "∞" shape tracks, wherein the number of tracks defines the number of sides of the polygonal braid, and wherein each loop of each "∞" shape track is intersected with another loop of a different "∞" shape track, so to form an intersection of tracks, and the feed gears are installed so that each one is centered within the center of a loop of one "∞" shape tracks and can mesh together.

5. The machine of claim 4, wherein said braid is obtained by forming four "∞" shape tracks on an upper part of the guide plate, in such a way that both loops of each track intersect with one loop of another track.

6. The machine of claim 4, wherein said braid is obtained by forming three "∞" shape tracks on the upper part of the guide plate, in such a way that both loops of each track intersect with one loop of another track.

7. The machine of claims 4, 5 or 6, wherein said intersection of the "∞" shape tracks is constructed as a plural number of sections.

* * * * *